US006844082B2

(12) United States Patent
Tzeng et al.

(10) Patent No.: US 6,844,082 B2
(45) Date of Patent: Jan. 18, 2005

(54) GAS DISTRIBUTION PLATE WITH ANODIZED ALUMNIUM COATING

(75) Inventors: Huan-Liang Tzeng, Hsinchu (TW); Jung-Hsiang Chang, Hsinchu (TW); Ping-Jen Cheng, Taoyuan (TW)

(73) Assignee: Taiwan Semiconductor Manufacturing Co., Ltd., Hsin Chu (TW)

( * ) Notice: Subject to any disclaimer, the term of this patent is extended or adjusted under 35 U.S.C. 154(b) by 69 days.

(21) Appl. No.: 10/424,447

(22) Filed: Apr. 28, 2003

(65) Prior Publication Data

US 2004/0211674 A1 Oct. 28, 2004

(51) Int. Cl.[7] ..... B32B 3/10; C25D 11/04

(52) U.S. Cl. ..... 428/596; 205/150; 205/153; 205/324; 205/328; 315/111.21; 428/469; 428/935

(58) Field of Search ..... 428/596, 469, 428/935; 205/150, 153, 324, 328; 315/111.21

(56) References Cited

U.S. PATENT DOCUMENTS 5,939,831 A * 8/1999 Fong et al. ..... 315/111.21

* cited by examiner

*Primary Examiner*—Robert R. Koehler
(74) *Attorney, Agent, or Firm*—Tung & Associates

(57) ABSTRACT

A new and improved, anodized aluminum gas distribution plate for process chambers, particularly an etch chamber. The gas distribution plate includes an aluminum body having multiple gas flow openings extending therethrough and an alumina anodized coating or layer on the plate. The gas distribution plate is characterized by enhanced longevity and durability and resists particle-forming deterioration and damage throughout prolonged use.

20 Claims, 2 Drawing Sheets

GAS DISTRIBUTION PLATE WITH ANODIZED ALUMNIUM COATING

FIELD OF THE INVENTION

The present invention relates to gas distribution plates (GDPs) which distribute gases into a processing chamber such as an etch chamber used in the etching of material layers on a semiconductor wafer substrate during the fabrication of integrated circuits on the substrate. More particularly, the present invention relates to an anodized aluminum gas distribution plate having an alumina anodized coating or layer to impart durability to the plate and reduce particle generation during etching or other processes.

BACKGROUND OF THE INVENTION

Integrated circuits are formed on a semiconductor substrate, which is typically composed of silicon. Such formation of integrated circuits involves sequentially forming or depositing multiple electrically conductive and insulative layers in or on the substrate. Etching processes may then be used to form geometric patterns in the layers or vias for electrical contact between the layers. Etching processes include "wet" etching, in which one or more chemical reagents are brought into direct contact with the substrate, and "dry" etching, such as plasma etching.

Various types of plasma etching processes are known in the art, including plasma etching, reactive ion (RI) etching and reactive ion beam etching. In each of these plasma processes, a gas is first introduced into a reaction chamber and then plasma is generated from the gas. This is accomplished by dissociation of the gas into ions, free radicals and electrons by using an RF (radio frequency) generator, which includes one or more electrodes. The electrodes are accelerated in an electric field generated by the electrodes, and the energized electrons strike gas molecules to form additional ions, free radicals and electrons, which strike additional gas molecules, and the plasma eventually becomes self-sustaining. The ions, free radicals and electrons in the plasma react chemically with the layer material on the semiconductor wafer to form residual products which leave the wafer surface and thus, etch the material from the wafer.

Referring to the schematic of FIG. 1, a conventional plasma etching system, such as an Mxp+Super-E etcher available from Applied Materials, Inc., is generally indicated by reference numeral 10. The etching system 10 includes a reaction chamber 12 having a typically grounded chamber wall 14. An electrode, such as a planar coil electrode 16, is positioned adjacent to a dielectric plate 18 which separates the electrode 16 from the interior of the reaction chamber 12. Plasma-generating source gases are provided by a gas supply (not shown) and flow into the reaction chamber 12 through openings 18*a* in the gas distribution plate 18. Volatile reaction products and unreacted plasma species are removed from the reaction chamber 12 by a gas removal mechanism, such as a vacuum pump 24 through a throttle valve 26.

Electrode power such as a high voltage signal is applied to the electrode 16 to ignite and sustain a plasma in the reaction chamber 12. Ignition of a plasma in the reaction chamber 12 is accomplished primarily by electrostatic coupling of the electrode 16 with the source gases, due to the large-magnitude voltage applied to the electrode 16 and the resulting electric fields produced in the reaction chamber 12. Once ignited, the plasma is sustained by electromagnetic induction effects associated with time-varying magnetic fields produced by the alternating currents applied to the electrode 16. The plasma may become self-sustaining in the reaction chamber 12 due to the generation of energized electrons from the source gases and striking of the electrons with gas molecules to generate additional ions, free radicals and electrons. A semiconductor wafer 34 is positioned in the reaction chamber 12 and is supported by a water platform or ESC (electrostatic chuck) 36. The ESC 36 is typically electrically-biased to provide ion energies that are independent of the RF voltage applied to the electrode 16 and that impact the wafer 34.

Typically, the voltage varies as a function of position along the coil electrode 16, with relatively higher-amplitude voltages occurring at certain positions along the electrode 16 and relatively lower-amplitude voltages occurring at other positions along the electrode 16. A relatively large electric field strength is required to ignite plasmas in the reaction chamber 12. Accordingly, to create such an electric field it is desirable to provide the relatively higher-amplitude voltages at locations along the electrode 16 which are close to the grounded chamber wall 14.

As discussed above, plasma includes high-energy ions, free radicals and electrons which react chemically with the surface material of the semiconductor wafer to form reaction produces that leave the wafer surface, thereby etching a geometrical pattern or a via in a wafer layer. Plasma intensity depends on the type of etchant gas or gases used, as well as the etchant gas pressure and temperature and the radio frequency generated at the electrode 16. If any of these factors changes during the process, the plasma intensity may increase or decrease with respect to the plasma intensity level required for optimum etching in a particular application. Decreased plasma intensity results in decreased, and thus incomplete, etching. Increased plasma intensity, on the other hand, can cause overetching and plasma-induced damage of the wafers. Plasma-induced damage includes trapped interface charges, material defects migration into bulk materials, and contamination caused by the deposition of etch products on material surfaces. Etch damage induced by reactive plasma can alter the qualities of sensitive IC components such as Schottky diodes, the rectifying capability of which can be reduced considerably. Heavy-polymer deposition during oxide contact hole etching may cause high-contact resistance.

The gas distribution plate 18 illustrated in FIG. 1 may serve multiple purposes and have multiple structural features, as is well known in the art. For example, the gas distribution plate 18 may include features in addition to the openings 18*a* for introducing the source gases into the reaction chamber 12, as well as those structures associated with physically separating the electrode 16 from the interior of the chamber 12. The openings 18*a* typically have a diameter of about 0.5 mm, and the gas distribution plate 18 is constructed of quartz.

One of the limitations inherent in the quartz gas distribution plate 18 is that plasma may damage or corrode the gas distribution plate 18 during plasma processes carried out in the chamber 12. Furthermore, over prolonged periods of use the quartz gas distribution plate 18 deteriorates and generates particles which have the potential to contaminate a wafer 34 processed in the reaction chamber 12. Accordingly, a new and improved gas distribution plate which is characterized by enhanced durability and resistance to damage and deterioration is needed for a reaction chamber.

According to the present invention, an anodized aluminum gas distribution plate is provided which is durable and resistant to plasma-induced damage and deterioration. Anodizing is a type of electrolysis by which a protective oxide coating is formed on a metal. Anodizing may serve several purposes, including forming a tough coating on a metal as well as imparting electrical insulation and corrosion resistance to the metal. Anodized aluminum and magnesium are commonly used in airplanes, trains, ships and buildings.

Anodizing processes are carried out in an electrolyte solution, in which the metal to be anodized acts as an anode or positive pole of the cell. Negatively charged oxide ions pass through the electrolyte solution and oxidize the surface of the metal. Aluminum is typically anodized in a sulfuric acid electrolyte solution, whereas magnesium is often anodized in a dichromate electrolyte solution. The thickness of the anodized coating is a function of the magnitude of the electric current which is passed through the solution. The anodized metal surface may be subjected to special treatments to give the metal a porous layer that can absorb dyes which are incapable of being rubbed or scratched off the surface.

An object of the present invention is to provide a new and improved gas distribution plate for a process chamber.

Another object of the present invention is to provide a new and improved gas distribution plate which is characterized by longevity and durability.

Still another object of the present invention is to provide a new and improved gas distribution plate which is suitable for use in etch chambers used in the fabrication of integrated circuits on semiconductor wafers.

Yet another object of the present invention is to provide a new and improved, anodized aluminum gas distribution plate.

A still further object of the present invention is to provide a method of fabricating an anodized aluminum gas distribution plate.

SUMMARY OF THE INVENTION

In accordance with these and other objects and advantages, the present invention is generally directed to a new and improved, anodized aluminum gas distribution plate for process chambers, particularly an etch chamber. The gas distribution plate includes an aluminum body having multiple gas flow openings extending therethrough and an alumina anodized coating or layer on the plate. The gas distribution plate is characterized by enhanced longevity and durability and resists particle-forming deterioration and damage throughout prolonged use.

According to a preferred method of fabricating the gas distribution plate, the plate body is constructed of aluminum and is immersed in a hard anodizing electrolyte solution such that all surfaces of the plate body are exposed to the electrolyte solution. The anodizing electrolyte solution has a concentration of typically about 15%, a current density of about 2–2.5 A/dm$^2$ and a voltage of about 20–60V, and the solution is maintained at a temperature of about 0–3 degrees C. during the anodizing process. The hard anodizing electrolyte may be sulfuric acid, although chromic acid or other anodizing electrolytes known by those skilled in the art may be used.

The alumina anodized coating or layer on the anodized aluminum plate body may be about 0.04 mm thick. Typically, the gas distribution plate includes about 88 gas flow openings. Each of the gas flow openings may have a diameter of about 0.78 mm to about 0.82 mm, and preferably, about 0.8 mm.

The present invention further includes a gas distribution plate fabricated by providing a plate body of aluminum and providing an alumina anodized layer on the plate body by immersing the plate body in an anodizing electrolyte solution and passing a current through the anodizing electrolyte solution while maintaining the solution at a selected temperature. The anodizing electrolyte is typically a hard anodizing electrolyte such as sulfuric acid, although alternative electrolytes such as chromic acid may be used. The sulfuric acid may have a concentration of about 15%, and the sulfuric acid bath is typically maintained at a temperature of about 0–3 degrees C. The current passed through the bath may be on the order of about 20–60V, and the electrolyte bath may have a current density of about 2–2.5 A/dm$^2$.

Preferably, the gas distribution plate fabricated according to the foregoing method has about 88 gas flow openings extending therethrough. Each of the gas flow openings may have a diameter of about 0.78 mm to about 0.82 mm, and preferably, about 0.8 mm. The alumina anodized layer may have a thickness of about 0.04 mm.

BRIEF DESCRIPTION OF THE DRAWINGS

The invention will now be described, by way of example, with reference to the accompanying drawings, in which.

DESCRIPTION OF THE PREFERRED EMBODIMENTS

The present invention is directed to an anodized aluminum gas distribution plate which is particularly applicable to etch chambers, particularly the MxP etch chamber available from Applied Materials, Inc. of Santa Clara, Calif. However, the anodized aluminum gas distribution plate of the present invention may be applicable to other types of process chambers used for the fabrication of integrated circuits on semiconductor wafer substrates.

Figure 1:
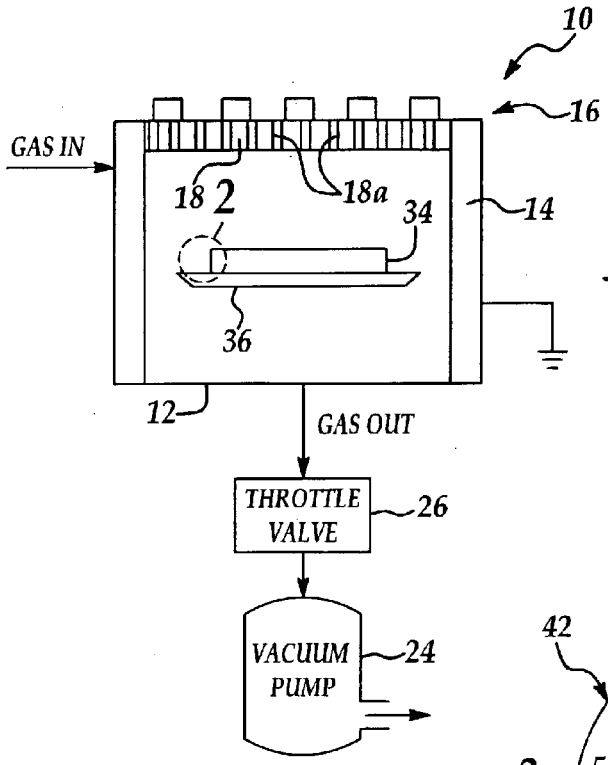
Figure 1 Prior Art
FIG. 1 is a cross-sectional, partially schematic view of a typical conventional etch chamber for processing semiconductor wafers.
Figure 2:
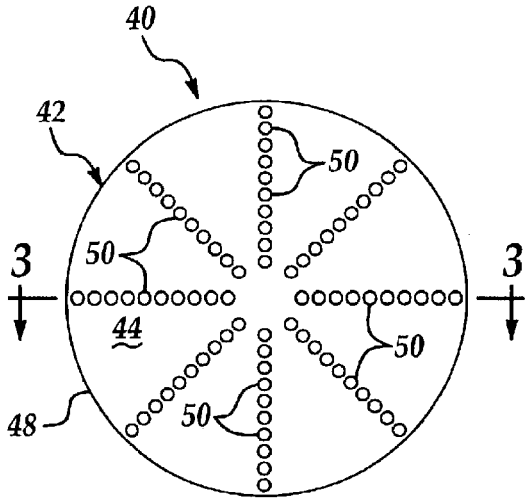
FIG. 2 is a top view of an illustrative embodiment of the anodized aluminum gas distribution plate of the present invention.
Figure 3:
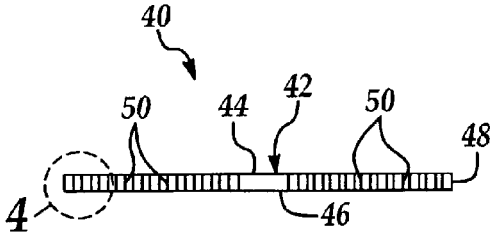
FIG. 3 is a cross-sectional view of the anodized aluminum gas distribution plate, taken along section lines 3—3 in FIG. 2.
Figure 4:
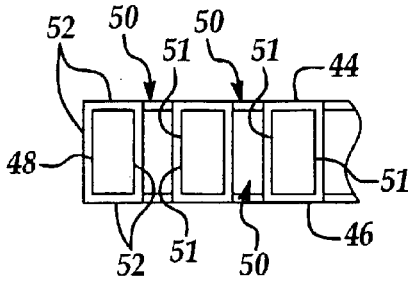
FIG. 4 is an enlarged cross-sectional view of the anodized aluminum gas distribution plate, taken along section line 4 in FIG. 3.

Referring initially to FIGS. 2–4, an illustrative embodiment of the anodized aluminum gas distribution plate (GDP) of the present invention is generally indicated by reference numeral 40. The GDP 40 includes a circular, aluminum plate body 42 having a top surface 44, a bottom surface 46 and a circular edge 48. Multiple gas flow openings 50 extend through the thickness of the plate body 42 and open onto the top surface 44 and the bottom surface 46, respectively. In a preferred embodiment, the plate body 42 includes eightyeight (88) of the gas flow openings 50. However, it is understood that any desired number of the gas flow openings 50 may be provided in the plate body 42 in any desired pattern. An alumina anodized layer 52 is coated on the top surface 44 and the bottom surface 46, as well as the edge 48 and opening surfaces 51 inside the gas flow openings 50. In a preferred embodiment, the alumina anodized layer 52 has a thickness of about 0.04 mm, leaving each of the gas flow openings 50 with a diameter of typically from about 0.78 mm to about 0.82 mm.

Figure 6:
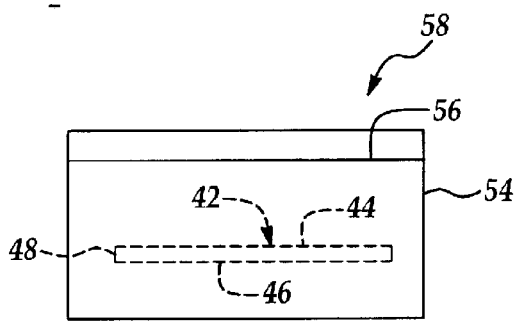
FIG. 6 is a schematic view of an anodizing electrolyte bath in typical fabrication of the anodized aluminum gas distribution plate of the present invention.
Figure 7:
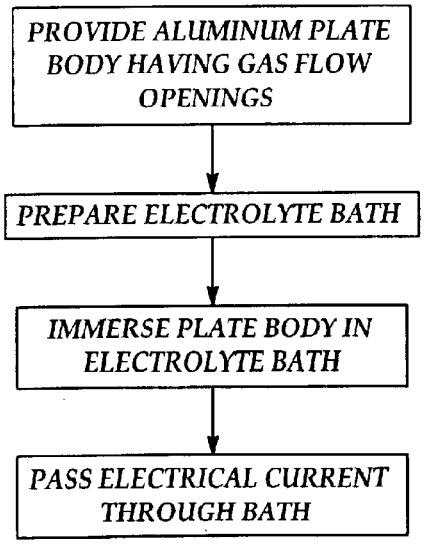
FIG. 7 is a flow diagram which summarizes typical steps in fabrication of the anodized aluminum gas distribution plate of the present invention.

Referring next to FIGS. 6 and 7, the anodized aluminum GDP 40 may be fabricated in the following manner. First, the aluminum plate body 42 is fabricated with the multiple gas flow openings 50 extending therethrough in a selected pattern, according to the knowledge of those skilled in the art. Next, an anodizing electrolyte bath 58 is prepared by placing an anodizing electrolyte solution 56 in an electrolyte tank 54. In a preferred embodiment, the anodizing electrolyte solution 56 is sulfuric acid ($H_2SO_4$) However, it is understood that other suitable anodizing electrolyte solutions known by those skilled in the art may be used instead. The plate body 42 is completely immersed in the anodizing electrolyte solution 56, with the top surface 44, the bottom surface 46, the edge 48 and the opening surfaces 51 (FIG. 4) directly exposed to the anodizing electrolyte solution 56. As the anodizing electrolyte solution 56 is maintained at a temperature of typically about 0–3 degrees C., an electric current of typically about 20–60 volts is transmitted through the electrolyte solution 56, with a current density of typically about 2–2.5 A/dm$^2$. The anodizing process is carried out for about 60–200 minutes in order to form the alumina anodized layer 52 having a thickness of about 0.04 mm. The fabrication steps for the anodized aluminum gas distribution plate 40 are summarized in FIG. 7.

Figure 5:
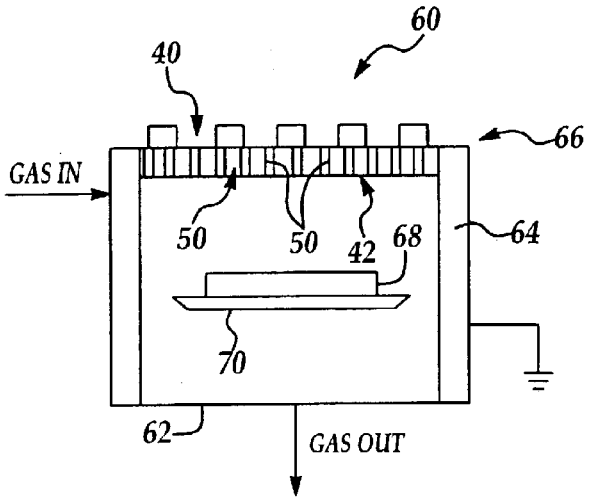
FIG. 5 is a cross-sectional, partially schematic view of a conventional process chamber in implementation of the present invention.

Referring next to FIG. 5, the anodized aluminum GDP 40 may be installed in a reaction chamber 62 of a conventional plasma etching system 60 such as an Mxp+Super-E etcher available from Applied Materials, Inc. The reaction chamber 12 includes a typically grounded chamber wall 64. An electrode, such as a planar coil electrode 66, is positioned adjacent to the gas distribution plate 40 which separates the electrode 66 from the interior of the reaction chamber 62. A semiconductor wafer 68 is positioned in the reaction chamber 70 and is supported by a wafer platform or ESC (electrostatic chuck) 70. The ESC 70 is typically electrically-biased to provide ion energies that are independent of the RF voltage applied to the electrode 66 and that impact the wafer 68. Plasma-generating source gases are provided by a gas supply (not shown) and flow into the reaction chamber 62 through the gas flow openings 50 in the gas distribution plate 40. Volatile reaction products and unreacted plasma species are removed from the reaction chamber 62 by a gas removal mechanism, such as a vacuum pump (not shown) through a throttle valve (not shown), in conventional fashion.

Ignition of a plasma in the reaction chamber 62 is accomplished primarily by electrostatic coupling of the electrode 66 with the source gases, due to the large-magnitude voltage applied to the electrode 66 and the resulting electric fields produced in the reaction chamber 62. Once ignited, the plasma is sustained by electromagnetic induction effects associated with time-varying magnetic fields produced by the alternating currents applied to the electrode 66. The plasma may become self-sustaining in the reaction chamber 12 due to the generation of energized electrons from the source gases and striking of the electrons with gas molecules to generate additional ions, free radicals and electrons. The plasma contacts the wafer 68 and etches material layers from the wafer 68 to define an electrically conductive circuit pattern on the wafer 68, as is known by those skilled in the art. It will be appreciated by those skilled in the art that the alumina anodized layer 52 on the plate body 42 prevents plasma-induced corrosion, deterioration and/or damage to the anodized aluminum GDP 40, thereby preventing generation of particles which would otherwise potentially contaminate the circuits being fabricated on the wafer 68 and prolonging the time intervals needed for periodic maintenance of the aluminum GDP 40. Furthermore, the anodized aluminum GDP 40 is capable of withstanding RF powers of up to 1200 watts, whereas conventional quartz GDPs can withstand RF powers of up to about 650 watts. In the event that it wears thin or becomes depleted due to prolonged use of the anodized aluminum GDP 40, the alumina anodized layer 52 can be replaced on the plate body 42 by re-subjecting the plate body 42 to the aluminum anodizing process heretofore described with respect to FIGS. 6 and 7.

While the preferred embodiments of the invention have been described above, it will be recognized and understood that various modifications can be made in the invention and the appended claims are intended to cover all such modifications which may fall within the spirit and scope of the invention.

What is claimed is:

1. An anodized aluminum gas distribution plate for a process chamber, comprising:

an aluminum plate body having a plurality of gas flow openings extending therethrough; and an alumina anodized layer coating said plate body.

2. The anodized aluminum gas distribution plate of claim 1 wherein said alumina anodized layer has a thickness of about 0.04 mm.

3. The anodized aluminum gas distribution plate of claim 1 wherein said plurality of gas flow openings comprises about 88 gas flow openings.

4. The anodized aluminum gas distribution plate of claim 3 wherein said alumina anodized layer has a thickness of about 0.04 mm.

5. The anodized aluminum gas distribution plate of claim 1 wherein each of said plurality of gas flow openings has a diameter of about 0.78 mm to about 0.82 mm.

6. The anodized aluminum gas distribution plate of claim 5 wherein said alumina anodized layer has a thickness of about 0.04 mm.

7. The anodized aluminum gas distribution plate of claim 5 wherein said plurality of gas flow openings comprises about 88 gas flow openings.

8. The anodized aluminum gas distribution plate of claim 7 wherein said alumina anodized layer has a thickness of about 0.04 mm.

9. An anodized aluminum gas distribution plate fabricated by:

providing an aluminum plate body having a plurality of gas distribution openings;

providing an anodizing electrolyte solution;

immersing said plate body in said anodizing electrolyte solution; and forming an alumina anodized layer on said plate body by passing an electrical current through said anodizing electrolyte solution.

10. The anodized aluminum gas distribution plate of claim 9 wherein said alumina anodized layer has a thickness of about 0.04 mm.

11. The anodized aluminum gas distribution plate of claim 9 wherein said plurality of gas flow openings comprises about 88 gas flow openings.

12. The anodized aluminum gas distribution plate of claim 11 wherein said alumina anodized layer has a thickness of about 0.04 mm.

13. The anodized aluminum gas distribution plate of claim 9 wherein each of said plurality of gas flow openings has a diameter of about 0.78 mm to about 0.82 mm.

14. The anodized aluminum gas distribution plate of claim 13 wherein said plurality of gas flow openings comprises about 88 gas flow openings.

15. The anodized aluminum gas distribution plate of claim 13 wherein said alumina anodized layer has a thickness of about 0.04 mm.

16. The anodized aluminum gas distribution plate of claim 15 wherein said plurality of gas flow openings comprises about 88 gas flow openings.

17. A method of fabricating a gas distribution plate for a process chamber, comprising the steps of:

providing an aluminum plate body having a plurality of gas distribution openings;

providing an anodizing electrolyte solution;

immersing said plate body in said anodizing electrolyte solution; and forming an alumina anodized layer on said plate body by passing an electrical current through said anodizing electrolyte solution.

18. The method of claim 17 wherein said anodizing electrolyte solution comprises sulfuric acid.

19. The method of claim 17 wherein said current is about 20–60 volts.

20. The method of claim 17 wherein said anodizing electrolyte solution has a current density of from about 2 to about 2.5 $A/dm^2$.

* * * * *